US006062031A

United States Patent [19]

Kim

[11] Patent Number: 6,062,031

[45] Date of Patent: May 16, 2000

[54] FAN CASING OF WINDOW TYPE AIR CONDITIONER

[75] Inventor: Jae-Soon Kim, Suwon, Rep. of Korea

[73] Assignee: Samsung Electronics Co., Ltd., Suwon, Rep. of Korea

[21] Appl. No.: 09/234,369

[22] Filed: Jan. 21, 1999

[30] Foreign Application Priority Data

Feb. 19, 1998 [KR] Rep. of Korea ..... 98-5201

[51] Int. Cl.[7] ..... F25D 23/12

[52] U.S. Cl. ..... 62/262; 62/278; 62/407; 62/419; 62/410; 62/411

[58] Field of Search ..... 62/407, 419, 410, 62/411, 262, 278

[56] References Cited

U.S. PATENT DOCUMENTS

| | | | |
|---|---|---|---|
| 4,553,405 | 11/1985 | Napolitano et al. | 62/262 |
| 5,065,596 | 11/1991 | Harris et al. | 62/262 |
| 5,065,597 | 11/1991 | Farfaglia et al. | 62/262 |
| 5,372,189 | 12/1994 | Tsunekawa et al. | 62/262 |
| 5,735,137 | 4/1998 | Kim | 62/410 |
| 5,775,123 | 7/1998 | Wakayama et al. | 62/407 |
| 5,806,334 | 9/1998 | Shin | 62/407 |
| 5,823,009 | 10/1998 | Suzuki et al. | 62/410 |

*Primary Examiner*—William Bennett
*Assistant Examiner*—Mark Shulman
*Attorney, Agent, or Firm*—Robert E. Bushnell, Esq.

[57] ABSTRACT

A fan casing of window type air conditioner adapted to smoothen and form corners of outdoor casing in slow curvatures having convex and concave surfaces and to lengthen draft holes, thereby increasing amount of sucked air, reducing disturbance and resistance of air flow to decrease eddy current phenomenon and noises, and obtaining a broader accommodation spaces of compressor and the like on the concave surfaces, the fan casing comprising: convex surfaces formed facing the outdoor fan for increasing a suction amount of external air and simultaneously minimizing disturbance and reduction of air flow by increasing the length of the plurality of draft holes; and concave surfaces formed facing the condenser for obtaining a broaden accommodation space of the compressor and the like at a predetermined position at the convex surfaces and securing a larger suction area of external air.

3 Claims, 3 Drawing Sheets

FAN CASING OF WINDOW TYPE AIR CONDITIONER

BACKGROUND OF THE INVENTION

1. Field of the Invention

The present invention relates to a window type air conditioner, and more particularly to a fan casing of window type air conditioner adapted to change the shape of a fan casing at an outdoor side and to lengthen draft holes, thereby being broaden a suction space of external air and increasing sucked volume of the external air at the same time.

2. Description of the Prior Art

A window type air conditioner according to the prior art includes, as illustrated in FIGS. 1 and 2 a base panel 10 an evaporator 20, a blade frame 30, and a control casing 40. At this time, the evaporator 20 and the blade frame 30 are coupled by an indoor casing 50, the control casing 40 is screwed to a side of the evaporator 20 and to a bottom surface of the blade frame 30 and the blade frame 30 is arranged with a plurality of vertical blades 60 for horizontal control of air flow.

Furthermore, the base panel is coupled at an upper surface thereof to an outer panel 70 having at both sides thereof with a plurality of draft holes 71 and the outer panel 70 is coupled to a front panel 80 for forming an exterior appearance of the air conditioner and for concurrently sucking and discharging the room air.

At this time, the front panel 80 is formed with a suction grille 81, a discharge grille 82 and a plurality of horizontal blades 90. The base panel 10 is provided with a compressor 100 and an outdoor casing 110. Between the outdoor casing 110 and the indoor casing 50 there are disposed a plurality of gap brackets 120.

Between the indoor casing 50 and outdoor casing 120, there is provided blowing means 150 for sucking the room air and external air into an indoor space 130 and outdoor space 140, circulating interiors thereof and discharging same outsides.

In other words, the blowing means 150 includes a motor 151, an indoor fan 152, and an outdoor fan 153 disposed at through hole 111 of the outdoor casing 110.

However, there is a problem in the conventional window type air conditioner thus constructed in that the plurality of draft holes 71 arranged at both walls of the outer panel 70 are formed shortened at lengths (La) thereof to limit infuses of external airs through the plurality of draft holes 70 and to result in insufficient air amount passing therethrough, thereby leading to insufficient cooling of a condenser 130.

There is another problem in that the air sucked through the outdoor space 140 becomes vortical by being resisted and disturbed in flow thereof by corners of the outdoor casing 110, thereby generating lots of noises.

SUMMARY OF THE INVENTION

The present invention is disclosed to solve the aforementioned problems and it is an object of the present invention to provide a fan casing of window type air conditioner adapted to smoothen and form corners of outdoor casing in slow curvatures having convex and concave surfaces and to lengthen draft holes, thereby increasing amount of sucked air, reducing disturbance and resistance of air flow to decrease eddy current phenomenon and noises, and obtaining a broader accommodation spaces of compressor and the like on the concave surfaces.

In accordance with the objects of the present invention, there is provided a fan casing of a window type air conditioner having an outer panel formed with a plurality of draft holes for suction of external air, an outdoor casing disposed at an external space of the air conditioner for sucked air to be dispersed and discharged into a condenser according to rotation of an outdoor fan and a compressor and a condenser respectively mounted at a front and a rear side of the external spaces, wherein the outdoor casing comprises:

convex surfaces formed facing the outdoor fan for increasing a suction amount of external air and simultaneously minimizing disturbance and reduction of air flow by increasing the length of the plurality of draft holes; and concave surfaces formed facing the condenser for obtaining a broaden accommodation space of the compressor and the like at a predetermined position at the convex surfaces and securing a larger suction area of external air.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
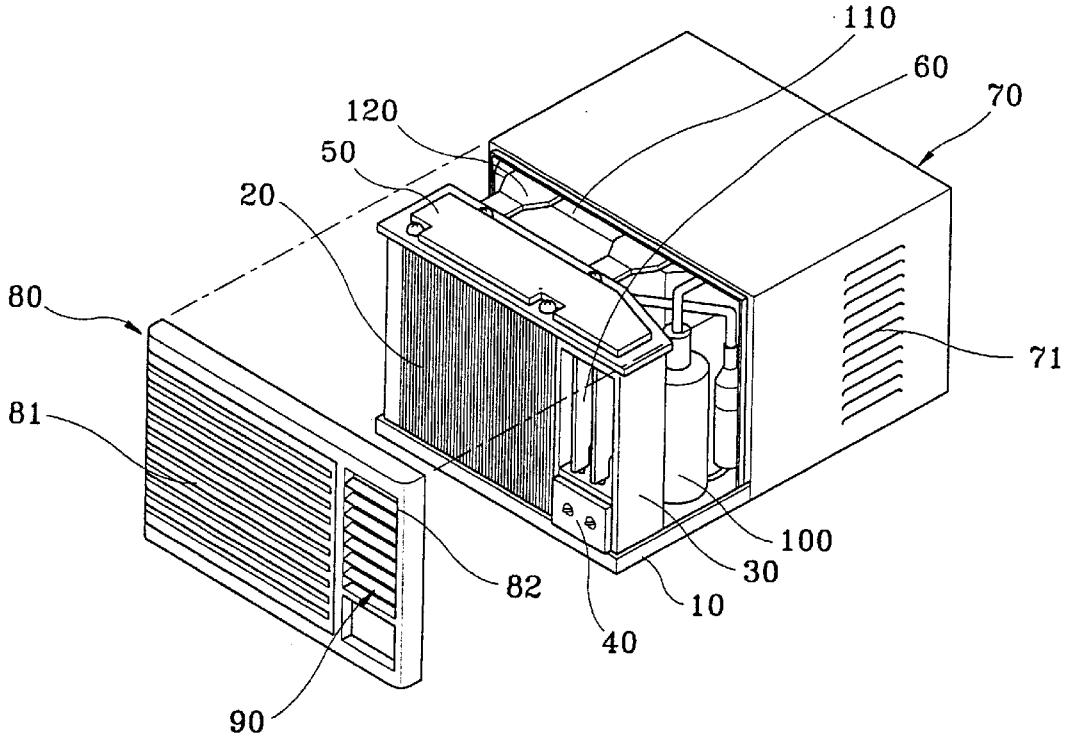
FIG.1 PRIOR ART
FIG. 1 is a perspective view of a conventional window type air conditioner.
Figure 2:
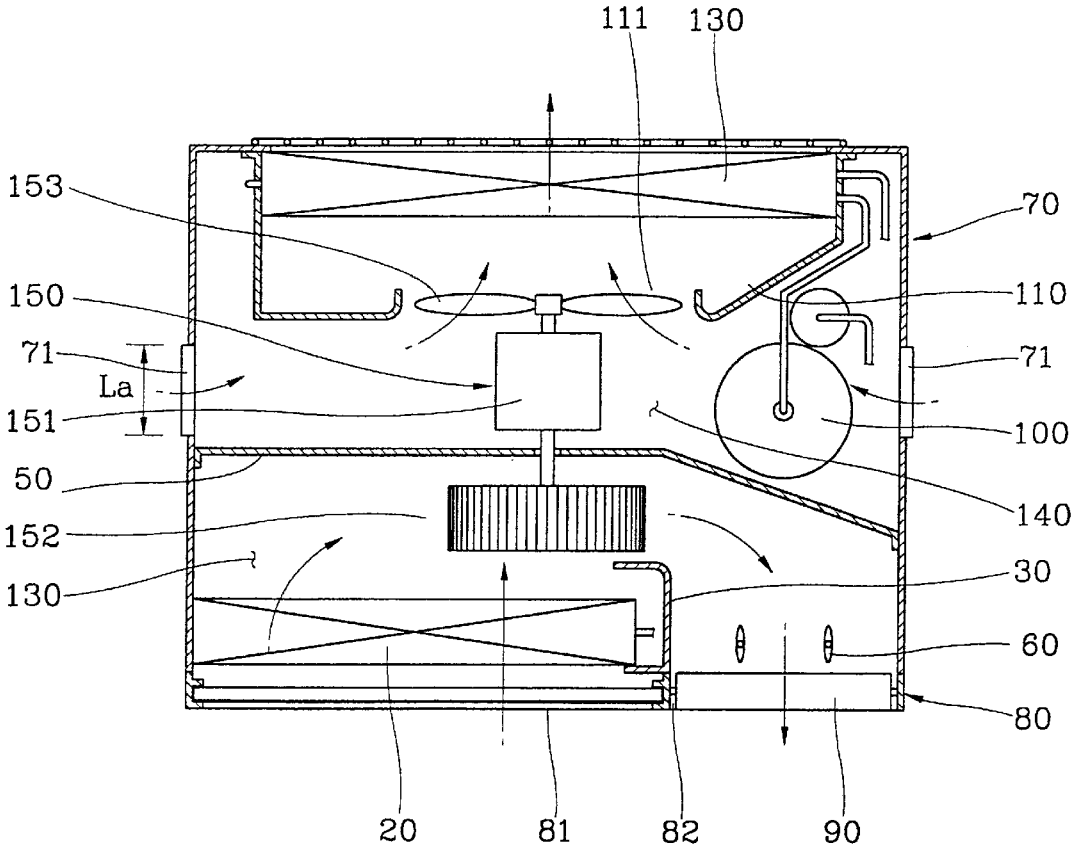
FIG.2 PRIOR ART
FIG. 2 is a plan of a conventional window type air conditioner.

The preferred embodiment of the present invention will now be described in detail with reference to FIG. 3. Throughout the drawing, like reference numerals and symbols are used for designation of like or equivalent parts or portions for simplicity of illustration and explanation.

Figure 3:
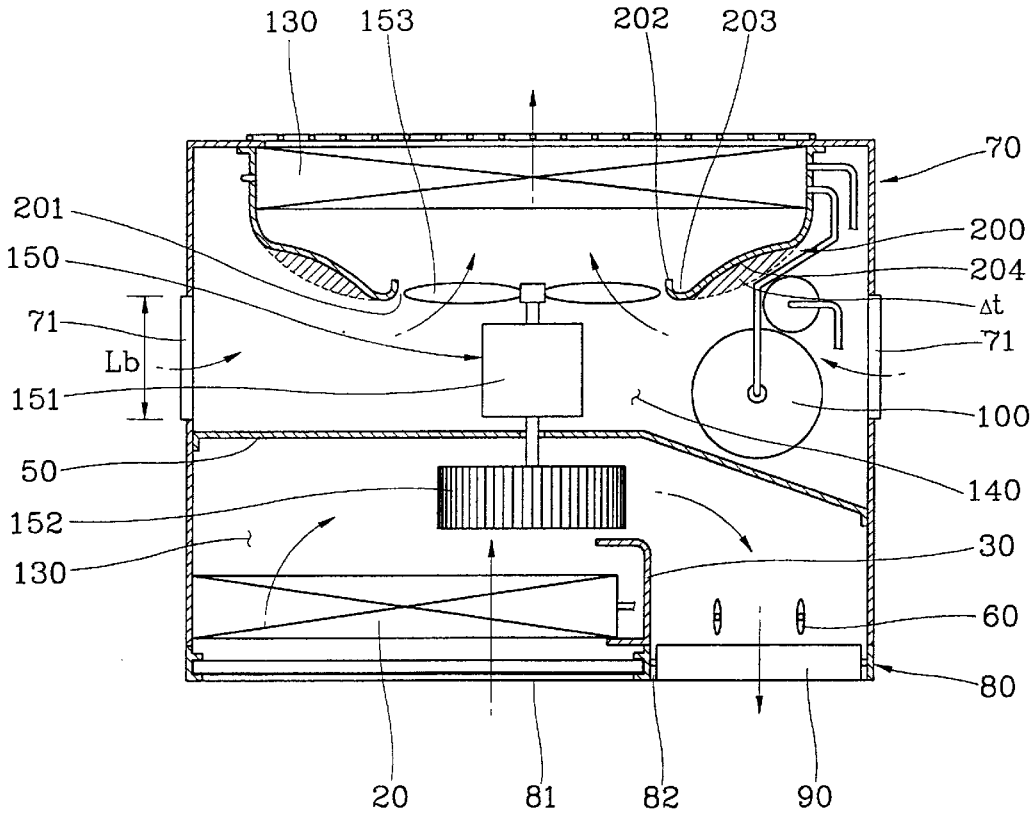
FIG. 3 is a plan of a window type air conditioner according to the present invention.

In FIG. 3, reference numeral 200 represents an outdoor casing of curved shape for increasing a sucked amount of external air and simultaneously minimizing disturbance and reduction of air flow by lengthening the lengths(Lb) of the plurality of draft holes 71 and for obtaining a broader accommodation space of the compressor 100 and the like and securing a larger suction area of the external air.

In other words, the outdoor casing 200 includes convex surfaces 203 formed facing the outdoor fan 153 for increasing a suction amount of external air and simultaneously minimizing disturbance and reduction of air blow by increasing the length(Lb) of the plurality of draft holes 71, and concave surfaces 204 formed facing the condenser 130 for obtaining a broadex accommodation space of the compressor 100 and the like at a predetermined position at the convex surfaces and securing a larger suction area of external air.

At this time, a through hole 201 is formed between said two convex surfaces 203 for the outdoor fan 153 to be inserted therethrough and for the air to pass. The through hole 201 is provided at a periphery thereof with a bell mouth 202 and each convex surface 203 has a hemicyclic shape when viewed from the top and sides. The concave surfaces 204 are lengthwise respectively formed at left and right sides of the convex surface 203.

Next, operational effect of the present invention thus constructed will be described in detail.

When a motor 151 at blowing means 150 is applied with an electric power and is rendered active, an indoor fan 152 is rotated by driving of the motor 151 to suck the room air which is in turn filtered by air filter (not shown).

The filtered air passes an evaporator 20, and is heat-exchanged to cold air which is in turn discharged along the arrow by guide of an indoor casing 50 disposed at the rear of the evaporator 20 to a blade frame 30 and concurrently discharged forward of the product to thereby cool the room.

The air is adjusted by control angles of the plurality of vertical blades 60 and horizontal blades 90 to a desired place in the room.

Meanwhile, when an outdoor fan 153 is rotated, the external air is sucked into an outdoor space 140 through the plurality of draft holes 71 to cool the compressed heat output from the compressor 100.

The air is then discharged along the arrow through the through hole 201 and passes the condenser 130 to cool the condensed heat output from the condenser 130.

At this time, as illustrated in FIG. 3, the outdoor casing 200 of curved shape having convex surfaces 203 and concave surfaces 204 serves to enlarge the length(Lb) of the draft holes 71 to thereby increase the sucked amount of the external air.

Furthermore, the air sucked through the plurality of draft holes 71 into the external space 140 is softly guided in flow thereof to the outdoor fan 153 to reduce eddy current phenomenon and noises.

The convex surface 203 is formed at left/right sides thereof with concave surfaces 204 to thereby generate a predetermined reduction area ($\Delta t$), so that a broader accommodation space for compressor 100 and the like is obtained a larger suction area is secured.

When the outdoor casing 200 according to the present invention and the outdoor casing 100 according to the prior art are respectively applied to a window type air conditioner and rotated by the same outdoor fan 153 up to 800 rpm, air amount according to the prior art was measured at 13.3 $m^3$/min while the air amount according to the present invention showed 14.3 $m^3$/min, which is 1.0 $m^3$/min larger than the prior art.

As apparent from the foregoing, there is an advantage in the fan casing of a window type air conditioner according to the present invention in that corners of outdoor casing is smoothened and is formed in slow curvatures having convex and concave surfaces and a plurality of draft holes are increased in length thereof, thereby increasing amount of sucked air, reducing disturbance and resistance of air flow to decrease eddy current phenomenon and noises, and obtaining a broader accommodation spaces of compressor and the like on the concave surfaces.

What is claimed is:

1. A fan casing of a window type air conditioner having an outer panel formed with a plurality of draft holes for suction of external air, an outdoor casing disposed at an external space of the air conditioner for sucked air to be dispersed and discharged into a condenser according to rotation of an outdoor fan and a compressor and a condenser respectively mounted at a front and a rear side of the external spaces, wherein the outdoor casing comprises:

convex surfaces formed toward the outdoor fan for increasing a suction amount of external air and simultaneously minimizing disturbance and reduction of air flow by increasing the length of the plurality of draft holes; and concave surfaces formed toward the condenser for obtaining a broaden accommodation space of the compressor and the like at a predetermined position at the convex surfaces and securing a larger suction area of external air.

2. The fan casing as defined in claim 1, wherein each convex surface has a hemicyclic shape when viewed from the top and sides of the air conditioner.

3. The fan casing as defined in claim 1, wherein the concave surfaces are respectively and lengthwise formed at left and right sides of the convex surfaces.

* * * * *